United States Patent [19]

Dennis, Jr. et al.

[11] 3,944,701

[45] Mar. 16, 1976

[54] PHOTOGRAPHIC FILM UNIT HAVING GRAVURE COATED, TAPERED THICKNESS LAYER

[75] Inventors: John J. Dennis, Jr., Watertown; Thomas P. McCole, South Natick, both of Mass.

[73] Assignee: Polaroid Corporation, Cambridge, Mass.

[22] Filed: Nov. 6, 1972

[21] Appl. No.: 303,685

[52] U.S. Cl. ..... 427/288; 101/150; 101/170; 427/428; 96/76 C; 96/76 R; 96/77; 428/68; 428/138; 428/156; 428/161; 428/172; 428/201

[51] Int. Cl.[2] ..... B05D 5/00

[58] Field of Search ..... 117/37 R, 111 R; 96/77, 96/76 C, 76 R; 427/288, 428

[56] References Cited

UNITED STATES PATENTS

| | | | |
|---|---|---|---|
| 3,496,005 | 2/1970 | Ishiwata et al. | 117/111 R |
| 3,499,786 | 3/1970 | Fry | 117/111 R |
| 3,694,206 | 9/1972 | Downey | 96/29 R |
| 3,761,268 | 9/1973 | Land et al. | 96/76 C |

*Primary Examiner*—George F. Lesmes
*Assistant Examiner*—William R. Dixon, Jr.
*Attorney, Agent, or Firm*—Alvin Isaacs; Susan M. Cooke; Esther A. H. Hopkins

[57] ABSTRACT

Method for making sheet materials are disclosed having a layer or layers of a non-uniform thickness, in particular a method of making sheet materials tapered from a maximum thickness near one and to a minimum thickness near the opposite end; and sheet materials prepared by such methods. The preparation of photographic film assemblages is disclosed including a first sheet material including at least one photosensitive layer and a second sheet material in super position therewith, which assemblages are adapted for forming photographic images viewable as reflection prints without separation of the respective sheet materials.

17 Claims, 7 Drawing Figures

PHOTOGRAPHIC FILM UNIT HAVING GRAVURE COATED, TAPERED THICKNESS LAYER

BACKGROUND OF THE INVENTION

Numerous forms of photographic, self-developing assemblages have been proposed in the prior art as well as being sold commercially, including both roll film and individual film units. The type of film assemblage or unit with which the present invention is concerned generally comprises a pair of sheets, one of which serves as a support for a photosensitive image-recording medium and a rupturable container of a viscous liquid processing agent adapted to be distruibted in a thin layer in contact with an exposed area of the photosensitive medium by superposing the sheets and avdancing them between a pair of pressure-applying members to distribute the processing liquid between the sheets for permeation into the recording medium. The photosensitive sheet (carrying the photosensitive medium) and the other or second sheet may be separated or superposed during exposure, are superposed during processing, and may be separated or allowed to remain laminated to one another by the processing liquid subsequent to processing; or they may be retained in superposed relation prior to, during, and subsequent to exposure and processing. Film units of this latter type are disclosed, for example, in U.S. Pat. Nos. 3,415,644, 3,415,645, 3,415,646, 3,473,925, 3,550,515, 3,578,540, 3,589,904, 3,594,164, 3,594,165, 3,607,285, 3,615,421, 3,615,436, 3,615,539, 3,615,540, 3,619,192, 3,619,193, 3,621,768, 3,652,281, 3,652,282, 3,672,890, and 3,689,262.

Whatever the basic format and structure of the film assemblage, it is important, particularly in film units of the type described in the aforementioned U.S. patents, to spread the processing liquid in a layer of uniformly predetermined thickness throughout the area exposed and processed, preferably to produce an image visible through one of the sheets. One approach to liquid spreading and spread thickness control is to employ juxtaposed pressure-applying members, particularly rollers, resiliently biased toward one another and move the film unit therebetween to first eject the liquid from a rupturable container attached to the sheets near the leading end of the area to be processed and then progressively spread the mass of ejected liquid toward the trailing end of this area and the sheets. Liquid spread thickness control is achieved by providing sheet-like spacing elements at least at the lateral margins of the sheets for separating the medial portions of the pressure-applying members and sheets in the area to be processed in order to provide space between the sheets in which the liquid is spread. Heretofore, such spacing means have taken the form of uniformly thick layers or sheets formed of such materials as paper, organic plastics, and metallic foil, or combinations thereof, in the form of sheets or layers having openings defining the image area or strips and/or combinations of strips and sheets adapted to define the area to be processed.

In the film unit structure described in the aforementioned patents, these spacing means are designed to perform a number of functions in addition to spread thickness control including masking of non-image areas e.g. forming a border, and securing the two sheets to one another at at least their lateral and trailing end margins. For this purpose, the spacing means take the form of a generally rectangular sheet formed with a rectangular exposure and/or viewing opening surrounded on at least three sides by lateral and trailing end marginal portions secured to one of the photosensitive and second sheets, folded around the lateral and trailing end edges of the sheets and secured to the other of the photosensitive and second sheets.

The copending application of Edwin H. Land, Ser. No. 250,611 now U.S. Pat. No. 3,761,268, relates to such film units wherein the spacing means is tapered to permit the developing liquid to be applied as a layer of more uniform thickness to obviate the problems which are inherent when the developing liquid is not so applied in a uniformly predetermined thickness. The spacing means of this copending application may be in the form of a binder sheet of known function having a central opening through which the film unit is photoexposed and/or through which the resulting image is to be viewed, the sheet being tapered from a maximum thickness near the leading edge (edge which exits from the exposure apparatus first) of the central opening to a minimum thickness at a point between the trailing edge of the central opening and the trailing edge of the sheet. This taper from maximum to minimum thickness may be on the order of 0.30 mil $\pm$ 0.03 mil.

SUMMARY OF THE INVENTION

The present invention is directed to novel methods for making sheet materials of non-uniform thickness, particularly sheet materials being tapered from a maximum thickness near one end to a minimum thickness near the opposite end, which sheet materials are especially useful in the film units described in the aforementioned copending application, Ser. No. 250,611, now U.S. Pat. No. 3,761,268. The present invention also contemplates novel sheet materials of this description.

In accordance with this invention, the sheet materials are prepared by applying to a base sheet one or more layers by gravure printing techniques, the tapering being accomplished by employing gravure rollers having side-to-side gradations in the pocket (cell) depth. Preferably, the sheet materials are prepared by applying a plurality of layers of a white pigment, e.g., titanium dioxide, at least one of these layers being so tapered. The present invention also contemplates sheet materials of this description including at least one tapered pigment layer. The pigment layer or layers may be applied to one or both sides of a base material to provide the desired tapered sheet material.

As was mentioned previously, the present invention is directed to sheet materials of non-uniform thickness, particularly to such sheet materials which are tapered from a maximum thickness near one end to a minimum thickness near the opposite end. Since the sheet materials prepared in accordance with this invention are especially useful in photographic film units of the type previously described, the nature and objects of the invention may best be understood by reference to such film units.

The film assemblages disclosed in the aforementioned U.S. Pat. No. 3,761,268 may be adapted to the performance of a number of different image-forming processes and particularly to the production of positive photographic prints, preferably in full color, produced by a diffusion transfer process in which a photographic image-recording medium including a photosensitive material such as a silver halide is exposed to form an image (latent) therein and is treated by wetting with a liquid processing agent to develop the image in the image-recording medium, form an imagewise distribution of transferrable image-forming substances and transfer the image-forming substances by diffusion to an image-receptive stratum in which they are immobilized to form a visible positive image.

A preferred embodiment of a film unit of this type includes all of the material and reagents required to produce a full color photographic print by a process such as disclosed in U.S. Pat. No. 2,983,606, and in many of the aforementioned U.S. patents. Such a film unit includes a photosensitive element comprising a silver halide emulsion and a dye developer, that is a dye which is a silver halide developing agent; an image-receptive layer of a dyeable material which may be carried on the same support as the photosensitive layer, (see, for example, U.S. Pat. Nos. 3,594,164 and 3,594,165); or on a separate support which is superposed with the image-recording medium, i.e., image-recording layer and support, at least during processing (see, for example, U.S. Pat. Nos. 3,415,644 and 3,415,646).

As noted in the aforementioned patents, the silver halide layer has associated therewith a dye image-providing material which provides an imagewise distribution of a processing composition diffusible image-forming substance as a function of exposure of its associated photosensitive silver halide such as the dye image-providing materials disclosed in the aforementioned patent numbers. Application of the liquid processing composition results in imagewise differential transfer of dye image-providing material to a contiguous image-receptive element or layer providing dye image formation in such an element as a function of the point-to-point degree of photoexposure of the silver halide layer.

Figure 1:
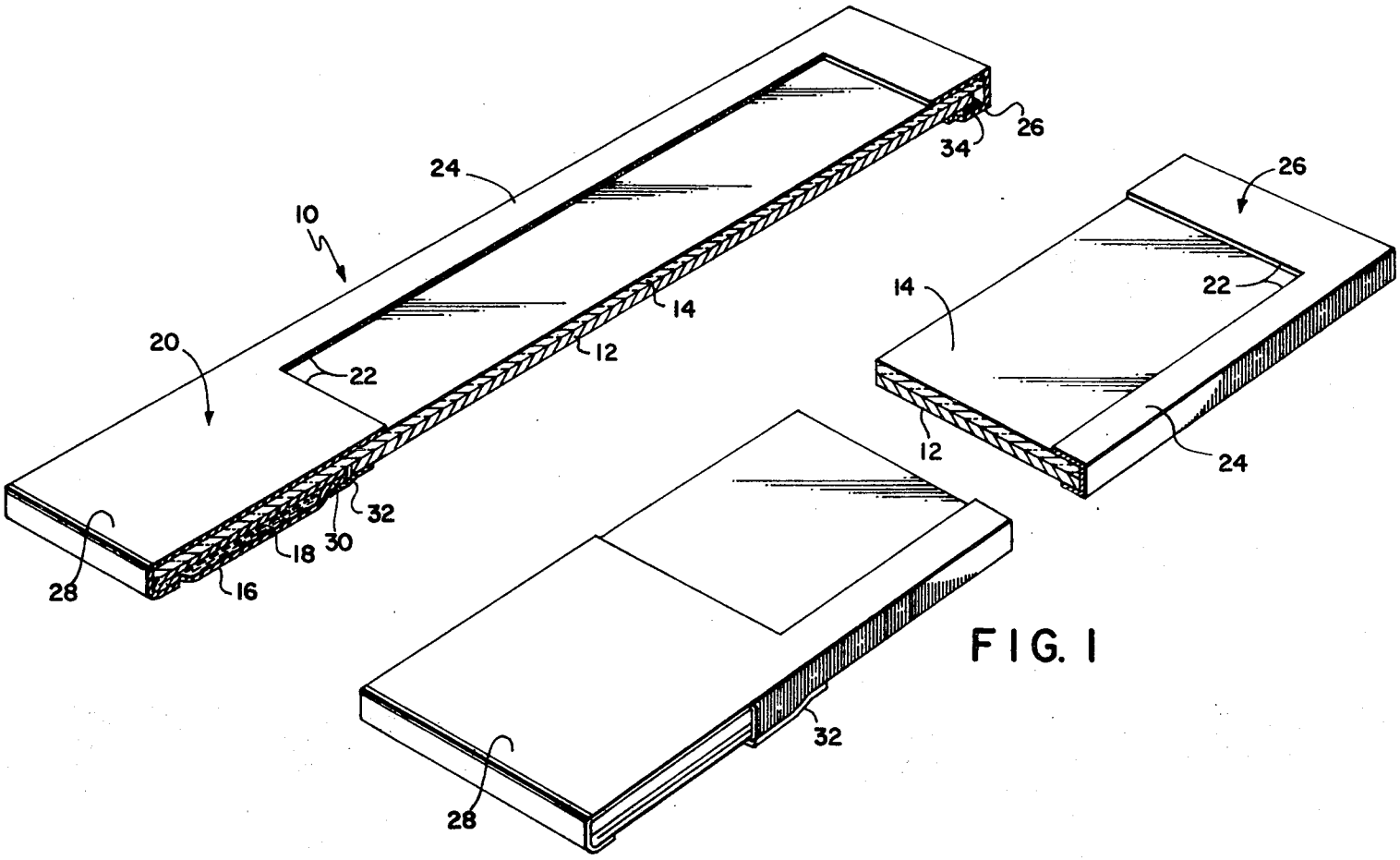
FIG. 1 is perspective view, partially in section, illustrating a typical film unit embodying the invention.

Reference is now made to FIG. 1 which shows an illustrative film unit of this description, the thickness of the material being exaggerated for clarity. Film unit 10 is essentially the same as the film unit described in the aforementioned U.S. Pat. No. 3,619,192 and comprises a photosensitive or image-recording sheet 12, a second or image-receiving sheet 14, and a rupturable container 16 holding a quantity of processing liquid 18. Sheets 12 and 14 are preferably rectangular and are arranged in superposed face-to-face contact with their lateral edges in alignment. Sheet 14 is preferably longer than sheet 12 having a length exceeding the length of sheet 12 by at least the shorter dimension of container 16 of processing liquid 18. Container 16 is mounted on the extended portion of receiving element 14 adjacent the leading edge of photosensitive element 12 in position to discharge its liquid contents between the photosensitive and image-receiving elements at the leading edge of the latter.

Photosensitive and image-receiving elements 12 and 14 are secured to one another at their lateral and trailing end margins by a binding element 20 (the original shape of which is shown most clearly in FIG. 2) in the form of a generally rectangular sheet larger than the image-receiving element. Binding element 20 is in the general form of a frame having a large rectangular exposure opening 22 defining the extent of the area in which the image is produced in the film unit, surrounded by lateral edge portions 24, a trailing end portion 26 and a leading end portion 28. Binding element 20 is secured to the outer surface of image-receiving element 14 with the lateral edges of exposure opening 22 located substantially parallel with and equally spaced from the lateral edges of sheets 12 and 14. Lateral marginal portions 24 of the binding element are folded around the lateral edges of sheets 12 and 14 and secured to the lateral margins of element 12. Trailing end portion 26 of the binding sheet is folded around the trailing edges of sheets 12 and 14 and secured to the outer surface of sheet 12 near the trailing edge thereof.

Container 16 is mounted on the extended portion of element 14. The leading end portion 28 of binding element 24 extends at least over sheet 14 and preferably around the leading edge thereof where it is secured at its leading end margin to container 16 to retain the container against the image-receiving element. In an alternative embodiment, the container 16 may be secured to element 14 so that binding element 20 need only extend to the leading edge of element 14. The preferred form of film unit shown is adapted to produce a reflection print surrounded by a white border and viewed against a white background so that binding element 20 is formed of an opaque white material to provide an aesthetically pleasing product as well as to prevent exposure of the photosensitive material by light admitted at or near the edges of sheets 12 and 14 if and as the film unit is moved directly into the light from between the pressure-applying members during processing.

Container 16 is of the type shown in U.S. Pat. No. 2,543,181, and is formed by folding a rectangular blank of a fluid impervious sheet material medially and sealing the marginal sections of the blank to one another to form a cavity for containing processing liquid 18. Such containers are well known, have been in use for many years, and include longitudinal, marginal sections 30 at which the seal is weaker than the end seals so that upon the application of a compressive force to the walls of the container in the region of the liquid-filled cavity, there will be generated within the liquid hydraulic pressure sufficient to separate longitudinal and marginal sections 30 throughout the major portion of their length to form a discharge mount at least equal in length to the cavity and the width of opening 22 through which procesing liquid 18 is discharged. Container 16 is mounted on sheet 14 with the edges of marginal sections 30 located adjacent the leading edge of sheet 12. A binding strip 32 is secured in overlapping relation to the leading edge of element 12 and longitudinal marginal section 30 of container 16 for cooperating with sheet 14 to form a passage for conducting the liquid from the container between the sheets at the leading end margin of sheet 12.

Film unit 10 is adapted to be processed by advancing the film unit, leading end foremost, between a pair of juxtaposed pressure-applying members preferably in the form of cylindrical rollers which may be rotated manually or by a motor for moving the film unit therebetween. The pressure-applying members or rollers initially pass over the container ejecting its liquid contents as an elongated mass between the leading end portion of sheet 12 and the facing adjacent portion of sheet 14. Continued movement of the film unit relative to and betwen the rollers results in spreading of the processing liquid as a thin layer betwen the sheets at least over the area defined by opening 22 in binding element 20. In order to insure distribution of processing liquid in a layer of the desired thickness over the entire area defined by opening 22, excess processing liquid 18 is provided in container 16 and provision is made within the film unit for collecting and retaining this excess processing liquid. A variety of liquid collecting and retaining structures are shown in many of the aforementioned patents including, for example, a spacing member 34 secured between the trailing edge portion of photosensitive element 12 and a trailing edge portion 26 of binding element 10 adhered to sheet 12. Spacing element 34 may take the form of a comb-shaped strip or a strip formed with perforations designed to space apart the pressure-applying members as they pass over the trailing end of the film unit and provide spaces within the trailing end of the film unit for collecting and retaining excess processing liquid overrun.

As previously indicated, the preferred form of film unit shown is adapted to be advanced from between pressure-applying members from the camera or other apparatus in which it is exposed into the light where processing continues to completion. The processing liquid and/or layers of the film unit contain agents for preventing or at least inhibiting further exposure of the photosensitive image-recording material and/or desensitizing the image-recording material so that it is not subjected to an image-forming exposure as it emerges into the light. In the particular film unit construction shown, the processing liquid is spread between the image-recording medium and the image-receiving layer which is carried on a transparent support in order to permit exposure of the photosensitive material and viewing of the diffusion transfer image formed in or on the image-receiving layer. Accordingly, the processing liquid not only comprises the agents necessary to produce a dye transfer image, e.g., an aqueous alkaline solution with a pH at which dye developers associated with the silver halide layers are soluble and diffusible, but also contains a light-reflecting agent in a quantity sufficient to mask the dye developers retained in the image-recording layer (laminted thereto) subsequent to processing. In the preferred embodiment, the light-reflecting agent and an optical filter agent as described in U.S. Pat. No. 3,647,437 will be present in the layer of liquid spread between the transparent sheet 14 and photosensitive sheet 12 which may be light opague, in a concentration sufficient to inhibit exposure of the image-recording medium by actinic radiation transmitted by transparent sheet 14. It is for these latter two reasons as well as to achieve uniform processing that it is important that the layer of processing liquid have a thickness maintained within relatively close tolerances. Typically, the processing liquid is initially distributed in a layer having a thickness of the order of 0.003 to 0.004 inch which is reduced as the solvent, i.e., water, is absorbed, to a layer having a thickness of the order of 0.002 inch. The light-reflecting agent is selected for its suitability as a background for viewing the dye transfer image formed in the dyeable polymeric image-receiving layer as well as for its opaque properties and its freedom from interference with the formation and color integrity of the dye transfer image. This agent should be aesthetically pleasing and should not provide a "noisy background" that may degrade the image or detract from the information content thereof. For this purpose, suitable light-reflecting agents are those providing a white background such as conventionally employed to provide backgrounds for photographic reflection prints and having optical properties particularly suited for the reflection of incident radiation.

As examples of suitable light-reflecting agents, mention may be made of barium sulfate, zinc oxide, titanium dioxide, barium stearate, silver flake, silicates, alumina, zirconium, acetyl acetate, sodium zirconium sulfate, and the like. Titanium dioxide is especially preferred for its whiteness and high reflection properties, and formulations of processing liquids including titanium dioxide are given in various of the aforementioned patents.

As is well known in the art and noted in the aforementioned patents, particularly U.S. Pat. No. 3,619,192, the depth of the layer of processing liquid initially spread between the sheets 12 and 14 is controlled by providing narrow strips or layers at the lateral margins of the area in which the liquid is spread and the image is formed. Whether the film assemblage comprises a plurality of image areas arranged in coiled strip form or a single exposure film unit, such strips or layers may be located between the sheets as shown, for example, in U.S. Pat. No. 2,627,460 and as will be noted from an examination of the various photographic film products (both in roll and film unit form) sold by Polaroid Corporation, in which spread control is achieved by a masking sheet located between the photosensitive and image-receiving sheets. In the preferred embodiment of the invention illustrated, marginal portions 24 of binding element 20 function to control the thickness of the layer of processing composition by engaging the end portions of the pressure-applying rollers and separating the medial portions thereof sufficiently to provide a space between sheets 12 and 14 in which the layer of processing liquid is distributed.

As previously noted, when processing a film assemblage or unit of the type incorporating the present invention, the leading end portion of the film unit which includes the container of processing liquid constitutes one of the thicker portions of the film unit offering substantially more resistance to movement between a pair of pressure-applying members than the portion of the film unit in the region of the area defined by opening 22 and adapted to be processed. Thus, whether the film assemblage be moved manually or by a motor driven system, there is more resistance to movement during the beginning of spreading so the speed of movement tends to increase throughout the spreading process resulting in a minimum thickness spread near the leading edge of the exposed area and layer of liquid, to a maximum thickness spread near the trailing edge of the exposed area and layer of liquid Not only does film assemblage thickness contribute to this problem, but it is further aggravated by the fact that the liquid is spread by advancing a mass thereof between the sheets and this mass decreases in volume during the spreading thereby resulting in a commensurate decrease in the resistance to movement of the film unit between the pressure-applying members.

Figure 2:
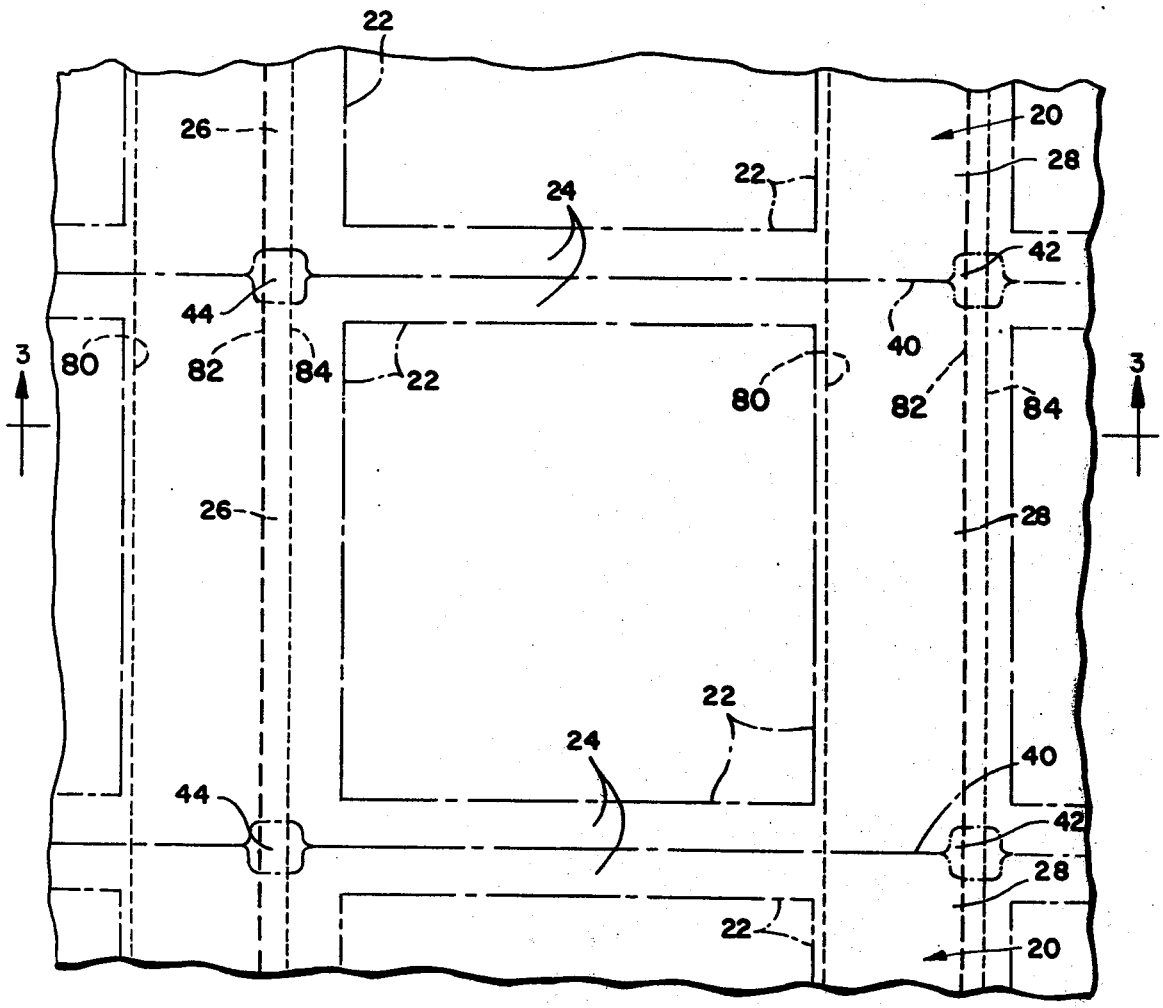
FIG. 2 is a plan view of a component of the film unit of FIG. 1.

In accordance with the invention described in the aforementioned copending application, Ser. No. 250,611, a uniform thickness layer of processing liquid is obtained by tapering the spread thickness control components of the film assemblage, e.g., binding sheet 20 of the illustrative film unit, opposite to the direction of taper that would be expected of the layer of processing liquid. This tapering is illustrated somewhat schematically in FIGS. 2 and 3. FIG. 2 shows a sequence of connected binding sheets 20 adapted to be severed from one another along the broken lines designated 40 which form the lateral edges of the individual binding sheets and along the dashed lines designated 82 which define the leading and trailing end edges of each binding sheet, which edges are notched at 42 and 44 so that each corner of each binding sheet 20 is cut off at approximately a 45° angle to prevent overlapping of the sheet material when the marginal portions are folded around the edges of sheet 14 and secured to the margins of sheet 12 and the margin of container 16. The inner reach of leading end portion 28 is designatd 80. In embodiments such as roll film in which a mask is employed between the sheets to control the image area as well as spread thickness, a mask sheet similar to the binding sheet shown may be employed, the principle differences being that the lateral edges of the sheet will be tapered longitudinally while the arrangement of openings will differ to provide wide trailing and leading end portions.

Figure 3:
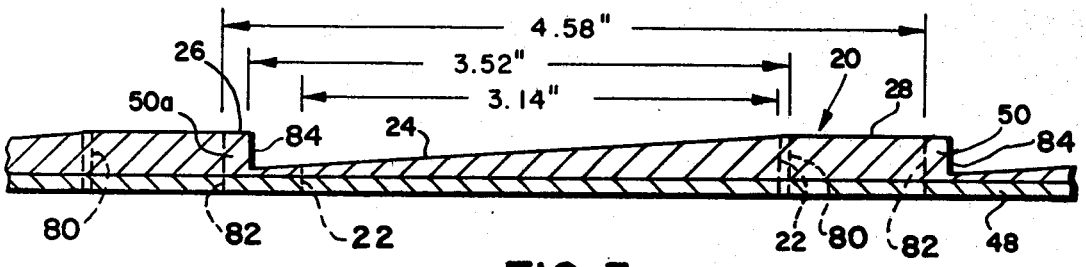
FIG. 3 is a sectional view taken substantially along the line 3—3 of FIG. 2.

The binding sheet 20 as illustrated in FIG. 3, comprises a dimensionally stable support sheet 48 on which is coated a multiple strata layer 50. Sheet 48 is of substantially uniform thickness, e.g. of the order of 1.0 to 1.5 mils, and may be formed of a multiple ply material composed, for example, of outer strata of thin "capacitor" tissue paper each approximately 0.3 mils thick adhered to opposite sides of a polyester film approximately 0.5 mil thick. A sequence of coatings are applied to support 48 to form layer 50 which is of uniform maximum thickness from the leading edge of element 20 to near the leading edge of opening 22 where it commences to taper uniformly to a minimum thickness proximate the base of stripe 50 toward the trailing edge of opening 22. Coating 50 essentially comprises a white pigment such as titanium dioxide in a polymeric binder designed to perform both mechanical and aesthetic functions. The mechanical function, as noted, is to control the spread thickness while the aesthetic funtion is to provide a pleasing white border surrounding the visible image.

A typical binding sheet 20 is illustrated by way of example in FIGS. 2 and 3 together with pertinent dimensions. The binding sheet is designed for use with a film unit having an overall dimension of approximately 4.25 by 3.5 in. with an image area approximately 3.14 in. square. The processing liquid is distributed within the film unit between sheets 12 and 14 by rapidly advancing the film unit between a pair of motor driven pressure-applying rollers, the speed of advancement being of the order of 10 inches per second, to form a layer of processing liquid approximately 0.003 in. thick. It has been found that the use of a uniform thickness binding element 20 may result in tapering of the layer of processing liquid by as much as 0.001 in. or 33⅓ percent and that variations in spread thickness due to mechanical factors such as deviations in spread roll concentricity, spread roll spread, gear chatter in the spread roll drive system, and the like, also contribute measurably to variations in the thickness of the layer of processing liquid spread between the sheets. However, it has been found that tapering of the marginal sections 24 of sheet 20 not only substantially eliminates the end to end taper of the layer of processing liquid, but also reduces or eliminates the variations in spread thickness resulting from mechanical factors such as noted above, thus producing a substantially uniformly thick processing liquid layer and a better quality and more pleasing image.

In the example shown, the support sheet 48 is coated on one side with a multiple strata layer basically comprising a layer or layers of titanium dioxide pigment applied in a polyester binder and overcoated with a clear lacquer consisting, for example, essentially of nitrocellulose and a wax modifier, for preventing dirt accumulation and cracking, and functioning as a friction-reducing coating. Typically, a base 1.24 mils thick is coated on one side to taper from a maximum overall thickness of 1.98 mils near the leading edge of opening 22 to a minimum thickness of 1.66 mils just beyond the trailing edge of the opening. A heat seal coating is applied to the opposite side of support sheet 48 to provide for lamination of sheet 20 to sheets 12 and 14. The heat-sealed coating consisting, for example, essentially of ethylene vinyl acetate, increases the maximum overall thickness to approximately 2.2 mils and the minimum thickness to approximately 1.92 mils thus providing a total difference in thickness between the ends of the tapered section of 0.28 mils. In the example given, the desired taper is 0.30 mils with a tolerance of $\pm 0.03$ mils, or approximately $10^{-4}$ times the length of opening 22. The difference in thickness between the ends of the tapered portions is therefore approximately fifteen percent of the maximum thickness.

Sheet 20 is initially provided as shown in FIG. 2, as a part of an extended sheet coated as shown as described, is cut along the broken lines 40 and 82, is adhered to sheet 14, and is folded around the lateral and trailing end edges of sheet 14 and adhered to the lateral and trailing end margins of sheet 12. In this way, the taper of the binding sheet is effectively doubled inasmuch as two layers (adhered to sheets 12 and 14) of the binding sheet engage the pressure-applying rolls as the film unit is moved therebetween. Thus, the taper is effectively increased to approximately 0.6 mils and this has been found effective to produce the desired uniformly thick spread.

It will be noted from FIGS. 2 and 3 that each trailing end portion of sheet 20 is provided with a stripe along the trailing edge comprising a portion of layer 50 and being of maximum thickness. The purpose of this stripe, designated **50*a* is to enable coiling of an elongated strip of sheets 20 by providing at least lateral margins which are of equal thickness. Stripe 50*a*, whose edge is designated 84, has no effect on the spreading of the processing liquid inasmuch as it is located beyond the trailing edge of opening 22** which defines the area in which spread thickness is critical.

While the white pigment layer which provides the tapered strips adjacent the lateral edges of the superposed sheets of the film unit is illustrated as a layer on a binding sheet which also functions to provide a border around the visible transfer image, it should be understood that the tapered layer may take other forms including, for example, narrow strips provided with tapered coatings or coatings applied directly to either or both of the photosensitive and second sheets such as shown in the copending U.S. application of Rogers B. Downey, Ser. No. 102,447, now U.S. Pat. No. 3,694,206. Alternatively, in film assemblages of both the film unit and roll film type in which a transfer image, usually a reflection print, is formed on an image-receiving sheet which is separated from the photosensitive sheet, the support of the image-receiving sheet is usually paper or a laminate coated with a white reflective material such as titanium dioxide so that it would be considered to fall within the scope of the present invention to build up and taper one or several of the coatings or layers comprising the receiving sheet in accordance with the teachings herein.

The present invention is directed to novel procedures for preparing tapered elements such as the binding element shown in FIGS. 1–3. In accordance with this invention, they may be prepared simply and efficiently by gravure coating techniques wherein gravure rollers are employed to apply one or more tapered layers to a base sheet to provide the desired tapered sheet material.

Conventional gravure coating or printing techniques employ a gravure roller typically having a plurality of pockets or cells (measured at so many a linear inch) in which the fluid to be applied to a sheet material is deposited from a fluid supply source, e.g., a well or fluid reservoir in which the roller is partially submerged. A doctor blade or the like is commonly employed to remove excess fluid before contact with the sheet material so that the thickness of the coating so deposited is essentially a function of the depth of these pockets or cells. [It will of course be appreciated that in procedures where patterns or printing is desired, the pockets are so arranged on the roller; whereas, in systems where a continuous layer is desired, the pockets are of suitable concentration so that areas of the sheet material corresponding to interstices between pockets of the roller are "filled in" with fluid to provide the desired continuous layer.]

A gravure roller is prepared by known photogravure processes using an appropriate screen to obtain maximum depth and suitable wall. Pockets of predetermined desired depth are obtained by controlling the rate of etch employed to prepare the pockets.

In accordance with the present invention, the desired tapered coating is obtained by providing gradations in the pocket (cell) depth from side to side of the roller in accordance with the predetermined taper contemplated. Thus, for example, and with reference to FIG. 3, the cells would be of maximum depth along areas of the roller corresponding to leading end portions 28 and trailing end portion 26 of element 20 wherein the strata of pigment 50 and 50*a*, respectively, are of maximum thickness, the depth of the cells being gradated therebetween to provide the shown taper.

While it is theoretically possible to apply the tapered layer in a single coating, in practical applications, the taper is provided by applying a plurality of separate layers, one or more of which may be of uniform thickness in combination with a layer or layers of tapered thickness.

A preferred base sheet for use in the practice of this invention (see FIG. 4) comprises a polyester such as polyethylene terephthalate which may be transparent or which may include a colorant such as a white pigment, the polyester having a thin paper base material laminated to both sides by means of a suitable adhesive. The paper base material may be normal density tissue, e.g., "capacitor" tissue having a density of 1.0. Such tissue possesses on the order of one pound of pulp/0.1 mil and is preferably a mil or less thick. The preferred base sheet structure may be on the order of 1.0 to 1.5 mils thick and may, for example, comprise a 0.50 mil white "mylar" (trademaark of E. I. duPont de Nemours & Co. for a film of polyethylene terephthalate resin) having a 0.30 mil thick capacitor tissue paper laminated to each side. Other base sheet structures may obviously be employed and one such alternative structure may, for example, comprise a 0.50 mil thick white mylar film having a 1.00 capacitor tissue paper laminated to one side by means of a suitable polyester adhesive. The adhesive layer employed in either structure may be on the order of 0.15 mil thick and may optionally include a pigment or other colorant, e.g., a white pigment such as titanium dioxide.

Figure 4:
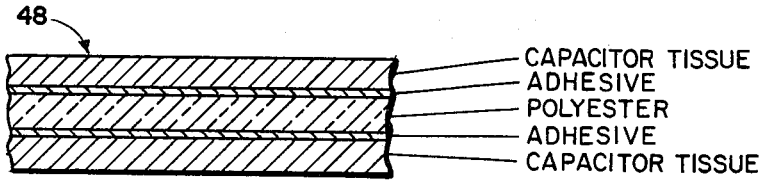
FIG. 4 is a dagrammatic cross-sectional view of a base sheet employed to prepare the tapered sheet materials of this invention.
Figure 7:
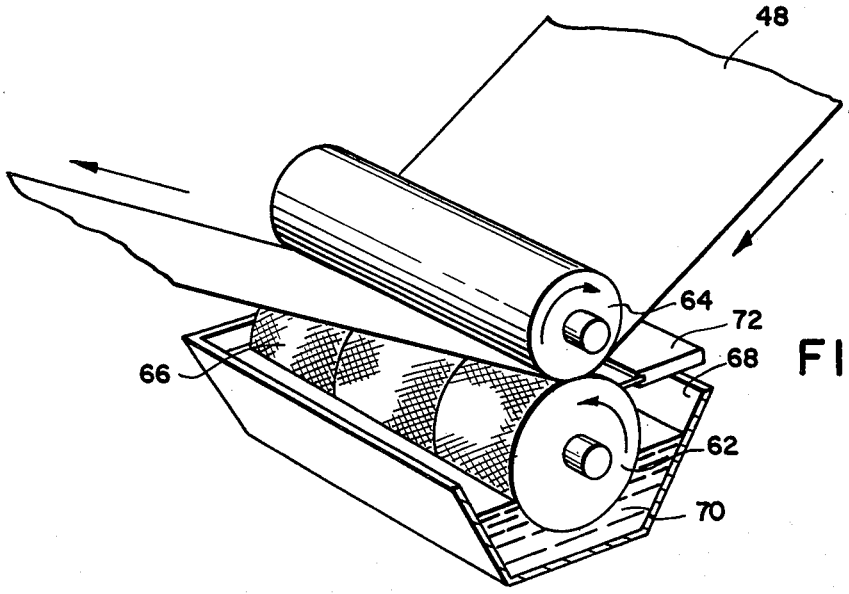
FIg. 7 is a partially schematic perspective view showing the gravure process by which the layers are applied to provide the tapered sheet materials.

FIG. 7 illustrates how a base sheet, e.g., the sheet of FIG. 4 is coated in accordance with the practice of this invention. As shown therein, sheet 48 to be coated is fed in the direction of the arrows between gravure roller 62 having pockets or cells 66 and a superposed roller 64. Roller 62 is shown to be partially submerged in coating fluid 70 contained in container 68. Doctor blade 72 is positioned so as to remove excess fluid from roller 62 so that the thickness of the coating of fluid 70 applied to sheet material 48 is essentially a function of the depth of cells 66.

As was mentioned previously, in accordance with this invention, the depth of cells 66 is gradated from side to side on the roller, so that the thickness of the coating so applied is tapered from the predetermined maximum to minimum thicknesses.

To prepare the binding element shown in FIGS. 2 and 3, conceptually sheet 48 and roller 62 should be of the linear dimension between the leading and trailing ends of element 20, e.g., 4.58 inches in the illustrative sheet 20. However, from the standpoint of commercial production, it is preferable if the width of sheet 48 and roller 62 is in multiples of the desired width; the coated sheet 48 then being slit longitudinally to provide multiple rolls of tapered sheet material of the desired width. In FIG. 7, the gravure roller is shown to contain three sets of cells. It will be appreciated that the gradations in each set are identical so that coated sheet 48 in effect contains three identical tapers. The thus coated sheet may then be slit longitudinally to provide three identical rolls of tapered sheet material prepared from the same gravure coating procedure.

While FIG. 7 illustrates a gravure roller wide enough to provide three rolls of tapered sheet material useful in the preparation of binding element 20, it is contemplated that the roller may be of sufficient width to provide eight such rolls, e.g., be 8 × 48 or approximately 40 inches wide. In production runs, the rolls of ssheet material 48 may be as long as 30,000 feet.

As was mentioned previously, while it is theoretically possible to apply the desired taper in a single coating, practical considerations make it desirable to employ a plurality of coatings to achieve this taper. Hence, practically speaking, coating 50 has previously been described in the illustrative description as a multiple strata layer.

Figure 5:
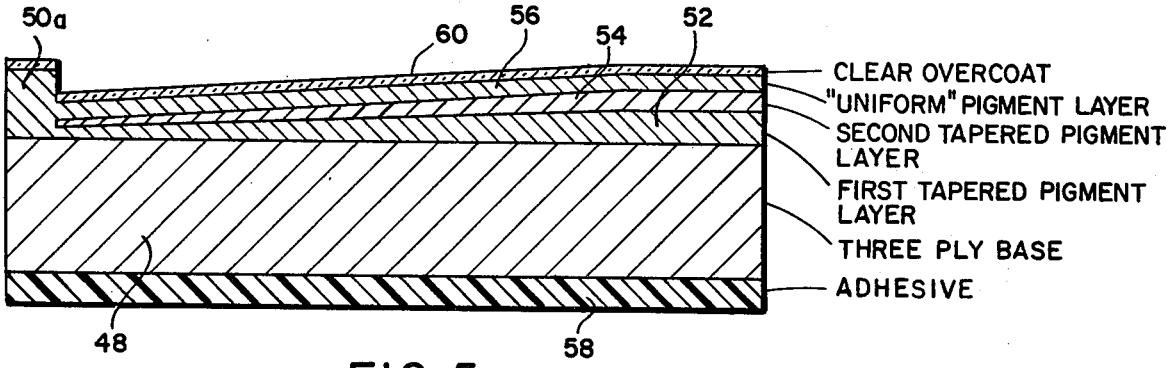
FIG. 5 is a similar view of one embodiment of this invention.

Such a multiple strata layer product is shown in FIG. 5 as comprising base sheet 48, e.g., the three ply base of FIG. 4, having a first tapered pigment layer 52, a second tapered pigment layer 54, and a "uniform" pigment layer 56. [The three pigment layers are applied in the manner shown in FIG. 7, as will be illustrated in more detail hereinafter.] The tapered sheet material is further shown to contain an adhesive 58 on the opposed surface of the base sheet 48 and a clear overcoat 60 over the pigment coatings. Adhesive coating 58, which may, for example, be a heat-activated adhesive such as a modified ethylene/vinyl acetate heat-activated adhesive, is employed to seal the tapered sheet material to another substrate, e.g., to elements 12 and 14 in the embodiment shown in FIGS. 1–3; whereas the clear overcoat 60, which may, for example, be a clear lacquer such as nitrocellulose with a wax modifier, serves such functions as reducing friction, preventing dirt accumulation, cracking, and/or otherwise protecting the outer surface of the sheet material.

The embodiment shown in FIG. 5 may be prepared by first coating a 1.24 mils thick three ply base (as shown in FIG. 4 and described previously) with titanium dioxide in a polyester binding to provide a tapered layer 52 of a 1.40 mils minimum thickness to a 1.66 mils maximum thickness. A second coating 54 is then applied to provide a minimum 1.45 mils and maximum 1.88 mils total thickness. "Flat" (uniform thickness) coating 56 is then applied, providing a 1.63 – 1.96 mils total thickness. [While the term "flat" or "uniform" thickness coating in employed to denote coatings applied by conventional gravure techniques wherein all of the pockets or cells are of the same depth, it will be noted that the minimum thickness actually increased 0.18 mil and the maximum thickness only 0.08 mil. This result, changing the taper from 0.43 to 0.33 in what may be termed a "reverse taper" was caused by the pressure at the nip of the rollers varying in the taper previously formed and to which the flat coating was applied, so that thinner areas of the previously tapered sheet (minimum thickness areas) received more of the flat coating.] Application of the lacquer overcoat resulted in a 1.66 – 1.98 mils thickness (0.32 taper); and final application of the heat-activated adhesive provided a final product with a 1.92 – 2.20 mils thickness (0.28 taper).

While only the tapered layers need be applied by gravure rollers in accordance with this invention, for economy and ease of production, all coating steps are preferably done by gravure. This is preferably done in a continuous run wherein the base material is fed through a series of gravure stations with a drying station located between each gravure station. The drying stations may, for example, be gas-fired hot air dryers and the sheet material may be fed through the various stations at a rate of on the order of 200 feet/minute with a drying time of about 6 seconds.

Figure 6:
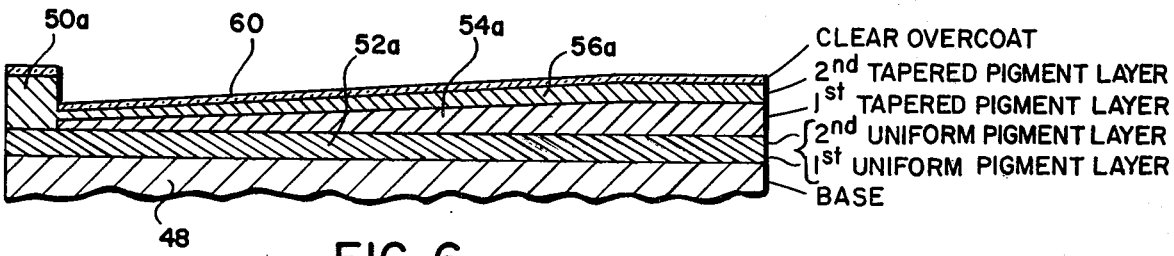
FIG. 6 is a similar view of another embodiment of this invention.

A particularly preferred tapered sheet material of this invention is shown in FIG. 6. In this embodiment, a first uniform or flat coating **52*a* is first applied to base 48, e.g., the aforementioned three ply structure, followed by first and second tapered coatings 54*a* and 56*a*. In the manner described above, clear overcoat 60 may be applied over the pigment coatings and an adhesive layer (not shown) applied on the opposed surface of base 48. The invention will be further illustrated below by a more detailed description of the preparation of the preferred tapered sheet material of FIG. 6**.

The gravure rollers employed were about 40 inches wide and about 27 inches in diameter. The rollers were divided across their width into eight equal parts, the cells in each part of the rollers employed to make tapered coatings being gradated in the same manner, so that the rollers were adapted to make a coated sheet material which could then be slit into eight substantially identical tapered sheet materials approximately 4.576 inches wide, as shown in FIG. 3. Gas-fired hot air dryers were stationed to permit drying between successive coating operations.

The first of the gravure rollers, adapted to provide uniform layer **52*a***, contained about 100 pockets/linear inch, the depth of the pockets being about 58 microns.

The second gravure roller, for preparing 1st tapered coating **54*a*, contained about 60 pockets/linear inch, the depth of the pockets in each of the eight equal parts being gradated laterally from 25–85 microns. More specifically, in order to provide maximum thickness area 50*a* at the trailing end equal to the maximum thickness at the leading end (FIG. 3**), the pocket depths in each of the eight 4.58 inch sections of the roller were about 85 microns for approximately the first quarter inch, then gradated from about 25–85 microns over the next 3.52 inches of the section, and 85 microns for the remainder of the section, these pocket depths recurring across the roller for the other seven sections thereof.

The third gravure roller, for providing 2nd tapered coating **56*a***, also contained about 60 pockets/linear inch, the pocket depths being gradated in the manner of the second gravure roller, except that the depths varied from 15–110 microns.

A fourth gravure roller of conventional uniform pocket depth and having approximately 100 pockets/linear inch was employed to apply a clear lacquer overcoat approximately 0.09 mil thick; and fifth and sixth gravure rollers of like description were employed together to form a heat-sealable adhesive layer on the free surface of the base material, the adhesive layer being about 0.30 mil thick. [Since the gravure coating technique does not readily permit application of this 0.30 mil adhesive layer in a single coating, the desired thickness was actually obtained in two stages. It may be done by applying two equal adhesive coatings, e.g., two 0.15 mil coatings = 0.30 mil, or by two unequal coatings, e.g., 0.08 and 0.22 = 0.30]

The three ply base material previously described (FIG. 4) was fed through the series of rollers and dryers at 200 feet/minute, the drying step after each coating being about 6 seconds.

The first gravure roller applied a flat coating of pigment about 0.2 mil thick; the second a pigment taper from 0.01–0.03 mil (minimum) to 0.18–0.21 mil (maximum) thickness; the third a pigment taper from 0.02–0.05 mil (minimum) to 0.17–20 mil (maximum) thickness; the fourth a lacquer coating of about 0.09 mil; the fifth an adhesive coating of about 0.08; and the sixth an adhesive coating of about 0.22 [to obtain an adhesive layer of about 0.30 mil].

From the foregoing figures, it will be seen that the precise taper may vary. Tolerances on the order of ± 0.06 mil and higher are satisfactory, although the preferred tolerance or variance is on the order of ± 0.03 mil. A typical tapered sheet material of FIG. 6 prepared in the foregoing manner may thus have a minimum thickness of 2.05 ± 0.05 mil; and a maximum thickness of 2.30 ± 0.05 mil (a taper of 0.25 mil ± 0.05 mil).

As was mentioned previously, the gravure rollers employed to prepare tapered coatings have on the order of 60 pockets/inch; whereas those employed to prepare flat coatings have on the order of 100 pockets/inch. Due to the fewer number of pockets, the rollers employed to prepare tapered coatings do not provide as smooth a layer so that the coating has a somewhat "mottled" or textured appearance observable to the naked eye upon close observance. This is not necessarily undesirable and, in fact, the tapered materials of FIG. 6, wherein the top pigment layer is tapered, possess such a textured appearance which is regarded as aesthetically pleasing and hence desirable. However, where perfectly smooth surfaces are found desirable, the top layer should be a flat pigment layer, as in the embodiment of FIG. 5.

Following completion of the coating operations described above, the thus coated sheet material was slit into eight equal sections to provide 8 equal rolls of the tapered sheet material of FIG. 6. These rolls may then be employed in the production of the film units of FIGS. 1–3.

This may be accomplished, for example, in a continuous assembly operation wherein the roll of tapered sheet material, elements 12 and 14, and rupturable container 16 are fed from supply sources into the production assembly equipment. In such an operation, individual elements 12 and 14 may first be laminated together, central opening 22 is provided in the moving roll of tapered sheet material to provide binding element 24 which is then heat sealed by means of adhesive layer 58 to one of elements 12 and 14, e.g., element 14. Rupturable container 16 is then sealed to the binding element 24 which is then cut into the individual units (see FIG. 2). [Note: it is preferred not to sever the roll of tapered sheet material provided with central openings 22 until this point, so that the continuous roll of binding elements 24 serves as the transport means for the individual film units through the assembly operation.] Following severance of the roll to provide the individual film units containing all of the essential materials, element 24 is cut at the corners (as shown in FIG. 2 and described previously), folded over the other of elements 12 and 14, e.g., element 12 in the described assembly, and then heat sealed thereto. The addition of binding strip 32 securing the leading edge of element 12 to container 16 (FIG. 1) thus completes assembly of the film unit which may then be transported to the packaging and shipping stations of the assembly operation.

While the invention has been described in detail in connection with its use in preparing photographic film units, it will be appreciated that the invention is not restricted thereto. It may obviously be employed in the preparation of various other sheet materials of non-uniform thickness and such other applications of this invention will be readily apparent to those skilled in the art in the light of the foregoing description.

It will be appreciated that the coatings applied in the practice of this invention need not provide a taper, e.g., a gradated increase in thickness, nor need the coatings cover the entire surface of the base sheet to which they are applied. The coatings may be applied in the form of a predetermined pattern. Alternatively, in lieu of having the coating thickness taper from near one edge of the sheet material towards the other, taper may be effected from opposite edges toward the center. It is therefore to be expressly understood that the foregoing description pertains only to the production of spacing means for the disclosed types of film units, the preferred use of the present invention, and this description is by way of illustration and not by way of limitation.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. In the method of manufacturing a photographic film assemblage including:

a. a pair of dimensionally stable elements in face-to-face contact having at least an image area therebetween;

b. a sheet-like support adjacent one of said elements; and c. at least a pair of elongated spacing layers each formed by applying to said sheet-like support at least a coating, tapered in thickness, of a pigment-containing liquid coating composition so that said spacing layers taper in thickness from a maximum near the leading end of said image area to a minimum near the trailing end of said image area, said supported spacing layers forming a spacing element which is adhered to at least one of said dimensionally stable elements at the lateral margins of said image area;

said assemblage adapted to be processed by a viscous liquid processing agent distributed between said dimensionally stable elements in a layer at least coextensive with said image area;

the improvement comprising preparing said spacing layers by doctoring said liquid into the cells of a gravure roller varying in depth according to the taper desired; pressing said gravure roller into contact with said support to transfer said liquid thereto; and drying said liquid to a solid state to form a tapered thickness coating.

2. The method of manufacturing a photographic film assemblage according to claim 1 wherein said tapered thickness coating is formed by successively coating said support with a plurality of strata of said coating composition, at least one of said strata being applied by a gravure printing utilizing a gravure roller having cells varying in depth to provide a tapered thickness strata.

3. The method of manufacturing a photographic film assemblage according to claim 2 wherein a stratum of said coating composition having a substantially uniform thickness is coated on said support to add to the thickness of said tapered thickness coating.

4. The method of manufacturing a photographic film assemblage according to claim 3 further including the step of overcoating said tapered thickness, pigment-containing coating with a relatively thin stratum of a substantially transparent material.

5. The method of manufacturing a photographic film assemblage according to claim 1 wherein a stratum of said coating agent having a substantially uniform thickness is coated on said suppport to add to the thickness of said tapered thickness, pigment-containing coating.

6. The method of manufacturing a photographic film assemblage according to claim 1 wherein said support is a sheet-like element initially independent of said dimensionally stable elements, said tapered thickness coating is applied to said support to form at least one of said spacing layers and thereafter said spacing layers are adhered to at least one of said dimensionally stable elements.

7. The method of manufacturing a photographic film assemblage according to claim 6 wherein a layer of a thermoplastic, polymeric adhesive is coated on the opposite side of said support from said coating, and said spacing layer is adhered to at least one of said elements through said adhesive by applying heat and pressure to said spacing layer to activate said adhesive.

8. The method of manufacturing a photographic film assemblage according to claim 6 wherein said spacing layers comprise a tapered, pigment-containing coating applied to a single support to form a spacing element, an opening corresponding to said area is formed in said spacing element and said sppacing element is adhered to at least one of said dimensionally stable elements adjacent the edges of said opening with said elements aligned substantially with the edges of said area.

9. The method of manufacturing a photographic film assemblage according to claim 8 wherein said spacing element is adhered to the outer space of one of said dimensionally stable elements is folded around at least the lateral edges of both of said dimensionally stable elements and adhered to the outer surface of the other of said dimensionally stable elements.

10. The method of manufacturing a photographic film assemblage according to claim 8 wherein a pigment-containing coating at least equal in thickness to the maximum thickness of said tapered, pigment-containing coating is applied to said support at opposite ends of said tapered pigment-containing coating.

11. In a method of manufacturing a photographic film unit comprising two substantially rectangular sheet-like elements secured in face-to-face relation by a binding sheet which is formed with a rectangular opening defining an image area and includes lateral, leading and trailing end sections surrounding said opening, said binding sheet adhered to the surface of one of said elements with at least part of said lateral sections of said binding sheet folded around the lateral edges of both said elements and adhered to the margins of the second of said elements;

the improvement comprising the steps of forming said binding sheet tapered in thickness at least at its lateral sections from a maximum near the leading end of the opening therein to a minimum at the trailing end of the opening by:

forming a gravure roller having at least a first region with cells of a uniform maximum depth and an adjacent second region having cells tapering from said maximum depth to a minimum depth;

doctoring a liquid containing a pigment into said cells;

pressing said gravure roller into engagement with a support sheet to transfer said liquid from said roller to said support sheet;

drying said liquid to form a solid, pigment-containing coating including a first area of substantially uniform maximum thickness and a second area tapering from said maximum thickness at said first area to a minimum thickness; and forming a rectangular opening in said second area.

12. The method of manufacturing a photographic film unit according to claim 11 wherein said first and second areas share a substantially linear, common boundary and said opening is formed with the leading edge thereof substantially parallel with and closely adjacent said boundary.

13. The method of manufacturing a film assemblage according to claim 11 wherein said support sheet has a length many times the width of a photographic film unit, said gravure roller is formed with at least a third region with cells of uniform maximum depth contiguous to said second region at the opposite end thereof from said first region for forming a solid, pigment-containing coating in a third area of said support sheet, and said regions extend circumferentially completely around said gravure roller and said roller is employed to form a pigment-containing coating on said support sheet having a plurality of elongated strips comprising said first, second, and third areas.

14. The method of manufacturing a photographic film unit according to claim 13 wherein said coated support sheet is cut along parallel lines to form an elongated strip having a width such that the lateral edges thereof lie in said first and third areas and is formed with a succession of spaced rectangular openings in said second area.

15. The method of manufacturing a photographic film unit according to claim 14 wherein said strip is severed transversely intermediate said openings to form a multiplicity of binding sheets.

16. The method of manufacturing a photographic film unit according to claim 14 wherein a plurality of said sheet-like elements are adhered to said strip with the lateral edges of said elements located in spaced parallel relation intermediate said openings prior to severing said strip.

17. The method of manufacturing a photographic film unit according to claim 16 wherein a layer of a thermoplastic, polymeric adhesive is coated on the opposite side of said support from said pigment-containing coating and a plurality of sheet-like elements are adhered to said strip by applying heat and pressure to said strip and said elements in regions surrounding the openings in said strip.

* * * * *